US007066186B2

(12) United States Patent
Bahr

(10) Patent No.: US 7,066,186 B2
(45) Date of Patent: Jun. 27, 2006

(54) METHOD AND APPARATUS MOUNTED ON A PAINTING SYSTEM TO CLEAN A PAINT FEED LINE

(75) Inventor: Thomas Bahr, Eiterfeld (DE)

(73) Assignee: ITW Oberflachentechnik GmbH & Co. KG, Dietzenbach (DE)

( * ) Notice: Subject to any disclaimer, the term of this patent is extended or adjusted under 35 U.S.C. 154(b) by 26 days.

(21) Appl. No.: 10/219,936

(22) Filed: Aug. 16, 2002

(65) Prior Publication Data

US 2003/0041884 A1 Mar. 6, 2003

(30) Foreign Application Priority Data

Aug. 17, 2001 (DE) ..... 101 40 216

(51) Int. Cl.
*B08B 9/053* (2006.01)
*B05B 15/00* (2006.01)

(52) U.S. Cl. ..... 134/56 R; 134/95.1; 134/98.1; 118/302; 239/120; 239/407; 239/413

(58) Field of Classification Search ..... 134/38, 134/56 R, 95.1, 98.1, 99.1, 100.1, 102.1, 134/102.2, 103.1, 166 C–167 C, 169 C, 134/171; 118/302; 239/104, 106, 110, 120, 239/121, 407, 413
See application file for complete search history.

(56) References Cited

U.S. PATENT DOCUMENTS 4,881,563 A * 11/1989 Christian ..... 134/166 C
5,330,101 A 7/1994 Turner et al. ..... 239/112
5,709,749 A * 1/1998 Dion et al. ..... 118/302
5,863,352 A 1/1999 Gonda ..... 134/38
6,037,010 A * 3/2000 Kahmann et al. ..... 427/426
6,090,450 A * 7/2000 Kahmann et al. ..... 427/8
6,193,167 B1 * 2/2001 Sunde ..... 239/112

FOREIGN PATENT DOCUMENTS

| | | |
|---|---|---|
| DE | 2043789 | 2/1973 |
| DE | 31 21 326 A1 | 6/1983 |
| DE | 9110650 | 10/1991 |
| DE | 91 10 650.8 U1 | 12/1991 |
| DE | 198 30 029 A1 | 1/2000 |
| DE | 199 37 426 A1 | 3/2001 |
| DE | 1 097 751 A2 | 5/2001 |
| DE | 100 64 065 A1 | 7/2001 |
| EP | 0888825 | 1/1999 |

OTHER PUBLICATIONS

Electronic translation of DE 9110650 U.*
Japanese Patrent Abstract, Publication No. 2001070874 A, Publication date Mar. 21, 2001.

* cited by examiner

*Primary Examiner*—Joseph L. Perrin
(74) *Attorney, Agent, or Firm*—Lowe Hauptman & Berner, LLP

(57) ABSTRACT

A method and apparatus are provided to clean a paint feed-line (1) of a painting system, line running from at least one paint tank (2, 9) to a paint deposition device (3) and feeding paint in this direction during the operational stages. During cleaning stages between operational stages, a cleaning substance is forced through the feed line (1). An inert gas, for instance nitrogen, is used as the gas for this purpose, and at the end of the cleaning stages the feed line (1) is filled with the inert gas. The gas remains in the feed line (1) until the next operational stage begins.

4 Claims, 1 Drawing Sheet

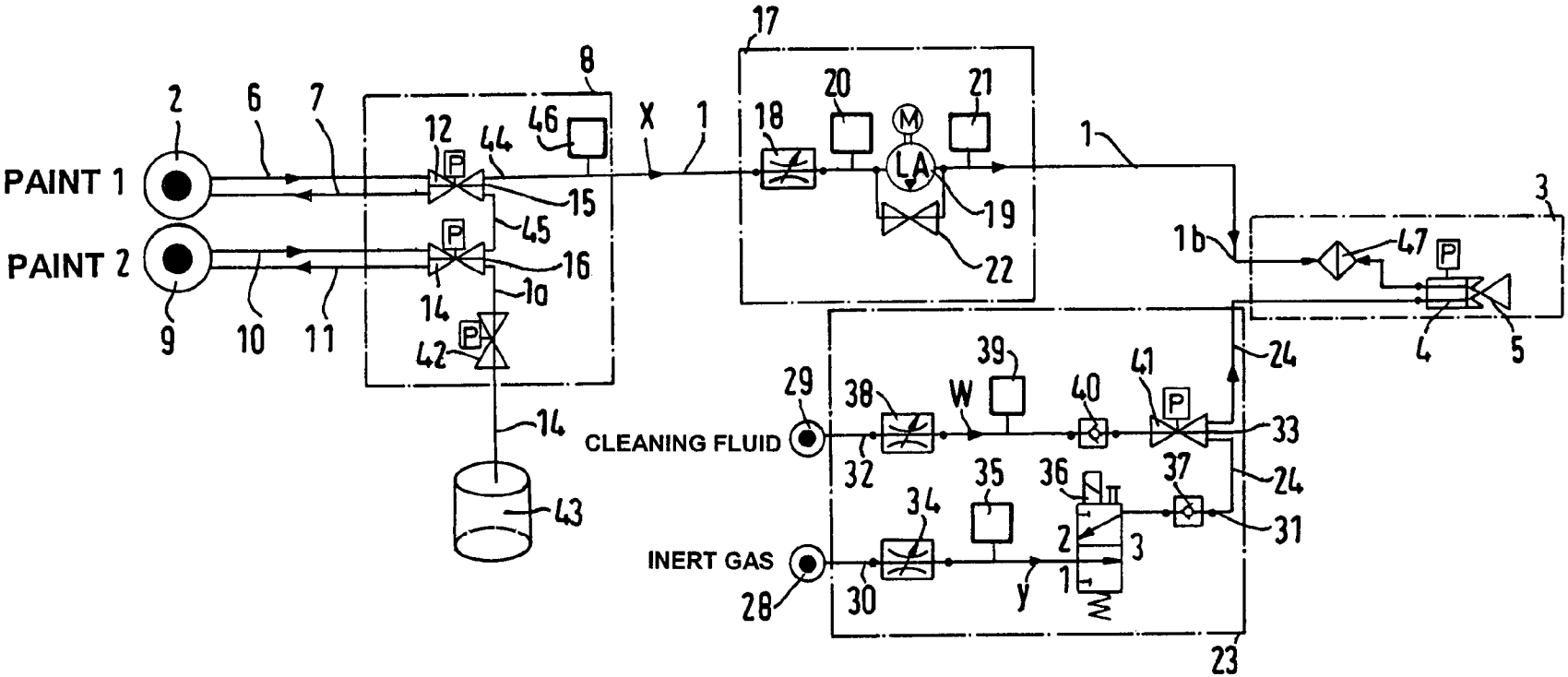
PAINT 1
PAINT 2
CLEANING FLUID
INERT GAS

METHOD AND APPARATUS MOUNTED ON A PAINTING SYSTEM TO CLEAN A PAINT FEED LINE

The present invention relates to a method defined in the preamble of claim 1 and to apparatus defined in the preamble of claim 8.

Methods and apparatus of this kind are used in particular in conjunction with painting systems in the form of robotic painting devices which are widely used for instance in the automotive industry to paint body parts. On the basis of customer behavior, production requirements (such as Just In Time) and the ever increasing number of colors, in particular as regards automobiles, such a painting system frequently must be converted to paints of different colors or to paints of varying properties, illustratively up to 80 changes in paint a day being commonplace. Accordingly modern painting facilities are equipped not only with powerful metering and paint-changing means allowing selection from up to 30 different paints, but also with rinsing and cleaning units precluding undesired residues of the previously used paint from reaching the particular workpiece surface after a change of paint has taken place.

Known methods and apparatus of the initially cited species carry out a cleaning stage between two operational stages involving different paints. This cleaning stage substantially applies to treating a feed line—which moves the paint from a selected supply tank of a color changing or paint changing unit to a deposition device (atomizing unit or the like)—by means of a cleaning substance typically in liquid form flowing through said feed line. Said cleaning substance is forced by compressed air through the feed line either in the direction of paint flow (German patent document 20 43 789 C3) or in the opposite direction (German patent document 91 10 650 U1). In both cases the cleaning substance must be removed from the feed line before the next operational stage begins. The cleaning effect may be enhanced by moving to-and-fro a ball or another body—generally called "pig"—in the feed line (European patent document 0 888 825 A2).

A problem arises with such methods and apparatus for cleaning feedlines in that the contemporary liquid paints and especially their hardeners are exceedingly sensitive to oxygen. Even minute paint residues react under ambient atmosphere, forming solid clumps or chunks which, while being small, nevertheless are visible on a smooth, painted surface and render the pertinent workpiece nearly useless. Such clumps being inevitable on account of the compressed air used in cleaning, it must be reliably removed from the feed lines before the new paint reaches the deposition unit, provided that, on one hand, comparatively large quantities of cleaning substance be used. On the other hand, a cleaning substance free of oxygen or air must remain in the feed line during the entire time interval between two operational stages using different paints in order to preclude formation during said time interval even of the tiniest air bubbles and hence paint clumps. As a result, at the beginning of new operational stage, i.e. at the beginning of a new painting stage, not only the cleaning substance per se, but furthermore a given minimum quantity of follow-up paint must be expelled from the deposition device and be transferred into a collecting container before the actual painting may start, in order to reliably preclude any residual quantities of the cleaning substances B which usually contain a solvent B from reaching the workpiece surface to be painted.

The quantities of paint and cleaning substance that are lost in this manner during each cleaning stage are considerable and amount to substantial costs. Also the paint and the cleaning substance must be removed as special wastes, entailing further costs and ecological loads. These factors apply regardless of the cleaning procedure being enhanced using a so-called pig or not.

Based on this background, the invention solves the technical problem of so implementing the method and apparatus of the initially cited species that lesser quantities of waste products of paint and cleaning substance are produced during the cleaning stages and that the danger of clumping due to paint residues shall be substantially averted.

This problem is solved by the features of claims 1 and 8.

The invention intrinsically offers the advantage that, because using an inert gas instead of compressed air, there no longer is any danger of converting liquid paint residues into solid clumps. As a result the cleaning stages may be made simpler in general and shall require only smaller quantities of cleaning substances. Lastly the invention attains substantial reduction of the paint and cleaning-substance wastes and accordingly contributes to ecological relief.

Further advantageous features of the invention are stated in the dependent claims.

The invention is elucidated below in relation to an illustrative embodiment shown as a schematic flow diagram in the attached drawing.

The attached drawing shows a conventional paint system, i.e. paint changing and metering equipment of painting apparatus illustratively appropriate to paint automotive body parts. A paint feed line 1 connects at a first end 1*a* to a paint tank 2 and is connected at a second end 1*b* to a depositing device 3 to set up flow communication. The depositing device 3 contains a depositing element 4 which illustratively may be a spray gun, an atomizer or another known element for sputtering, spraying, or other deposition of paint by a jet 5. All remaining parts of the deposition device 3 which are without significance to the invention have been omitted for the sake of simplicity.

Preferably the tank 2 is connected by a recirculation line comprising a forward conduit 6 and a return conduit 7 to a color-changing or paint-changing unit 8. At least another tank 9 is connected to said unit preferably outside the tank 2 and for that purpose another recirculation line also comprising a forward duct 10 and a return duct 11 is used. A controlled valve 12 and 14 resp. is configured in each of said recirculation lines and connects the pertinent forward duct 6, 10 either to the associated return duct 7, 11 or, at either of two hookup sites 15, 16 to the first end 1*a* of the feed line 1. When the forward duct 6, 10 is connected to the pertinent return duct 7, 11, liquid paint held in the pertinent tank 2, 9 shall circulate at a predetermined pressure (for instance about 4 bars) in the pertinent recirculation line. If on the other hand the valve 12, 14 connects the forward duct 6, 10 to the associated hookup site 15 or 16, then the paint shall be expelled from the associated tank 2, 9 into the feed line 1 and therein shall be moved toward the deposition device 3.

The tanks 2 and 9 illustratively are pressure-resistant tanks or containers fitted with membrane or piston pumps pumping paint in conventional manner as regards painting systems of the type under discussion paint into the recirculation line 6, 7 or 10, 11. Hereafter the tanks 2, 9 therefore shall be generically called "paint sources".

A metering unit 17 is used to accurately meter the paint. In the shown illustrative embodiment, said unit contains a paint pressure regulator 18 and illustratively a motor-driven gear pump acting as the metering pump 19, said regulator and pump being mounted sequentially in the feed line 1. The pressure before the metering pump 19 may be measured by a pressure sensor 20, another pressure sensor 21 mounted downstream of the metering pump 19 measuring the pressure at which the paint is fed to the deposition device 30. The paint shall be fed from the tank 2, 9 to the deposition device 3 depending on which of the two valves 12, 14 is open to the feed line 1. Furthermore a bypass line 22 running parallel to the metering pump 19 may be branched onto the feed line 1 in order that, where specific sorts of paints are involved, part of the paint may pass through this bypass line 22 instead of through the slowly running metering pump 19.

Equipment of the above described kind are well known to the expert and therefore need no further explanation. To avert repetition, therefore, the initially cited patent documents (DE 91 10 650 U1, DE 20 43 789 C3; EP 0 888 825 A2) are incorporated by the present citation into the object of the present invention.

In the invention, the above described equipment comprises also a rinsing unit 23 operating with an inert gas, preferably nitrogen, to clean the feed line 1. The rinsing unit 23 is connected by a line 24 either directly or through an omitted valve of the deposition device 3 in such a way to the second end 1*b* of the feed line 1 that, in this valve position, paint supplied from the feed line 1 shall issue in the form of the jet 5 from the deposition device 3 whereas, in another valve position, the line 24 is connected to the feed line 1 to allow flow. Typically however the deposition element 4 comprises a closed passageway connected to the lines 1, 24, to which passageway is connected a spray nozzle or the like. When painting does not take place, said nozzle shall be sealed off by means of a needle that shall be retracted from the nozzle to allow spraying in order to release the jet 5.

The rinsing unit 23 comprises a source of inert gas 28 and a source of cleaning fluid 29. The inert gas source 28 illustratively consists of a conventional nitrogen bottle which, due to opening a valve, expels gaseous nitrogen due to opening a valve into a line 30 connected through an adapter 31 to the line 24. On the other hand the cleaning fluid source 29 illustratively consists of a tank from which pressurized cleaning fluid may be forced into a line 32 connected through an adapter 33 to the line 24. The line 30 contains, as seen in the direction of flow of the inert gas (arrow y), in sequence, a pressure regulator 34, a pressure sensor 35, a controlled valve 36 that for instance is a two-way valve, and a check valve 37 preventing undesired media from flowing back in the direction opposite that of the arrow y. In this configuration the components 34 through 37 not only are a means to connect the inert gas source 28 to the feed line 1, but at the same they represent a means to fill this feed line with inert gas as discussed in further detail below. Accordingly, and as seen in the direction of flow of the cleaning fluid (arrow w), the line 32 contains in sequence a pressure regulator 38, a pressure sensor 39, a check valve 40 and a controlled valve 41, said means allowing feeding cleaning fluid at the adapter 33 into the line 24. In this instance too the check valve 40 prevents undesired backflows. As discussed further below, the components 30 through 41 furthermore constitute means to generate a foam mixture.

Similarly to the case of the tanks 2, 9, the cleaning fluid source 29 may contain a pressure container or a container equipped with a pump system. In this manner the desired pressure may be set by the pressure regulator 38 and be monitored by the pressure sensor 39.

As shown in the drawing, the first end 1*a* of the feed line 1 issues through a controlled outlet valve 42 into a collecting container 43. The configuration preferably shall be such that, seen from the outlet valve 42, the hookup sites 15 and 16 are downstream (arrow x) from said valve 42 and are connected by line segments 44, 45, which are as short as possible, to the valves 12, 14. A proximity switch or the like, for instance an inductive or capacitive sensor 46—of which the function shall be discussed further below—is mounted directly downstream of the last hookup site 15.

Operation of the described painting system and of the rinsing unit 23 of the invention substantially is as follows:

First the valves 12, 14, 36, 41 and 42 are closed in the course of a typical operational stage. When thereupon one of the valves 12, 14 is opened, the kind of paint that shall be emitted through the deposition device 3 during the operational stage has then been selected. Depending on the kind of paint used, the valve 22 is open or closed. Assuming an open valve 12, liquid paint then shall flow from the tank 2 at the rate set by the pressure regulator 18 and metering pump 19 and monitored by the pressure sensors 20, 21 to the deposition device 3, as a result of which said device 3 can be conventionally driven by manually opening or closing its output nozzle. This operation remains unchanged as long as the paint from the tank 2 is being processed.

If painting shall be switched to the paint of the tank 9, then there shall be first a cleaning stage for the feed line 1. For that purpose—and while the deposition device 3 is shut down—the valve 36 of the rinsing unit 23 is opened and as a result the inert gas from the inert gas source 28 moves through the lines 30 and 24 and the deposition device 3 or directly into the second end 1*b* of the feed line 1. The inert gas pressure displayed at the sensor 35 is determined in this process by the setpoint of pressure regulator 34. The inert gas pressure (for instance 10 bars) is selected in such a way that the paint in the feed line 1 is forced back opposite the typical flow direction (arrow x) toward the tank 2 or its recirculation line. Because line segment 44 is short, the return of the remnant paint may be almost total.

The sensor 46 monitors this process and emits a signal as soon as the boundary surface between paint and inert gas passes it by. This signal may be used by means of an omitted and preferably automated control device to close the valve 12 and to open the outlet valve 42. As a result, the minute quantity of paint still in front of the column of inert gas now shall be forced through the end 1*a* of the feed line 1 into the collecting container 43. Therefore only a small amount of paint must be removed as waste.

The valve 41 of the rinsing unit 23 may be opened simultaneously with the response of the sensor 46. Accordingly a liquid cleaning substance, i.e. a solvent, flows out of the tank 29 into the line 32 and then moves at rate set by the pressure regulator 38 and monitored by the sensor 39 through the hookup site 33 into the line 24. By appropriately adjusting the pressures and conveyance rates, preferably the cleaning fluid and the inert gas shall form a foam mixture of cleaning or rinsing fluids where, as in the above instance, the clean inert gas is forced in the back direction through the feed line 1 until lastly the front of the column of foam mixture enters the collecting container 43.

Moreover, during this procedure, the element 4 of the depositing device 3 may be briefly opened and be rid thereby from paint. If the inert gas is appropriately pressurized, the rinsing unit 23 will operate in the manner of a high-pressure cleaning unit, hence also extremely effectively and rapidly. Also the foam mixture may be adjusted in different ways depending on the paint being used in order to always carry out optimal rinsing.

The valve 41 controlling the cleaning fluid shall be closed shortly after the sensor 46 has identified the boundary surface between the inert gas and the foam mixture and has emitted a pertinent signal. The cleaning also may be selectively terminated at the end of a predetermined time interval beginning with application of cleaning fluid or the response of the sensor 46. As a result, again only inert gas shall be driven through the feed line 1 and the cleaning substance still in said line shall be fully expelled into the collecting container 43. Termination of this procedure once again is displayed by the sensor 46, or else a predetermined time interval may be used.

Shortly thereafter the entire feed line 1 is filled solely with inert gas, and thereupon the valve 42 is closed and this state is preserved until the beginning of the next operational stage and illustratively the valve 14 shall be opened instead of valve 12 and the valve 30 shall be closed. This procedure assures that in the time interval between the termination of the actual cleaning procedure and the beginning of the next operational stage, the inert gas shall be at so high a pressure in the feed line 1 that entry by air or oxygen due to uncontrollable leaks shall be reliable avoided.

In one preferred embodiment of the present invention, the valve 36 also shall be closed after the feed line 1 has been filled with inert gas to a pressure for instance up to 1 bar selected by the pressure regulator 34, whereby the feed line 1 shall be closed on all sides. Thereupon the pressure in the feed line 1 is monitored continuously by the pressure sensors 20, 21. If a component were non-hermetic or if any medium flows in uncontrolled manner from the outside into the feed line 1, then this condition shall be detected by the sensors 20, 21 and an alarm signal, a shutoff signal for the full equipment or the like shall be generated. During this procedure the valve 22 preferably shall be open.

Where called for and when closing the valve 36 and opening the valve 14 at the latest simultaneously with the beginning of the next operational stage, the element 4 of the deposition device 3 may be reopened. In this manner the newly supplied paint first shall expel the inert gas column present in the feed line 1. The sensor 46 signaling the inflow of paint may be used in this process to determine the lead time—determined by the length of the feed line 1—preceding the actual painting in the event there should not be spraying inert gas on the workpiece to be painted is to be averted. However, inert gas being involved, in general, no harm will arise by pointing the element 4 directly after the paint has-been released through the valve 14 onto the particular workplace surface and by some inert gas initially reaching the workpiece surface.

When the painting system is in normal operation, the feed line may be checked for defects in the same way as described above in relation to the inert gas by using the paint pressure in this line 1. For that purpose and for instance after a preset time (for instance 10 s) after termination of the particular last paint removal from the deposition device 3, the particular valve 12, 14 shall be closed, furthermore the paint pressure at that time in the feed line 1 shall be the specified pressure and be monitored by the pressure sensors 20, 21. If this pressure rises or drops in undesired manner, the automated control device again shall generate an alarm or shutdown signal or the like. In this case also the valve 22 shall be preferably open. If painting shall resume thereafter, the particular valve 12, 14 are reopened and the valve 22 is closed again.

In particular when the inert gas in the inert gas source 28 is nitrogen, it shall be preferably kept preferably at a minimum temperature illustratively equal to or larger than 10° C. or 20° C. In this manner the paint being used may not be cooled for instance to less than 5° C., at which level many paints would be ruined.

As regards panting systems wherein more than one depositing device 3 is connected to the feed line 1, it may be appropriate to select a higher paint pressure (for instance 15 to 20 bars) in the recirculation lines 6,7 or 10, 11. In such a case further valves or the like to reduce the pressure in the recirculation lines 6, 7 or 10, 11 during the cleaning stages—that is that will regulate down, to values sufficiently smaller than the pressure of the inert gas (for instance 10 bars)—will precede the valves 12, 14 in order to assure the desired paint recovery during the cleaning stages. After the paint has been forced back into the particular recirculation line 6, 7 or 10, 11, the required feed pressure will be re-established in said line.

The invention offers many advantages. In the first place, by using an inert gas which will not react with the paints involved and by subsequently filling the feed line 1 with the inert gas, the remnant paint in the feed line 1 shall not be converted into interfering clumps or the like. This feature applies over the full duration of the cleaning stage between two operational stages. As a result, a particular procedural step may be eliminated, namely that for safety sake at the beginning of an operational stage first a given quantity of paint issuing from the deposition device 3 would be introduced into a collecting container in order to reliably preclude depositing the cleaning substance on the workpiece surface, in other words, as regards the invention, the newly issuing paint may be used at once and without incurring wastes. Another advantage is that during the cleaning stage a cleaning foam composed of the cleaning fluid and the inert gas can be used in the cleaning stage, whereby the required quantities of cleaning fluid are considerably reduced. Both features substantially lower costs because the expenditures of removing special wastes are commensurately lowered. All danger of paint residues forming clumps or the like having been eliminated, the intensity of the cleaning labor may be lowered. Besides, paint remaining in the feed line 1 after an operational stage may be recovered near totally.

The invention offers the further advantage that the described method allows cleaning in problem-free manner not only the feed line 1 per se, but also all its fittings, valves etc. (for instance 16, 18, 19, 20, 21, 22)—a feature pigs allow attaining only with difficulty because such pigs as a rule cannot cross fittings or the like. Lastly all above described procedures may be controlled automatically and accordingly the present invention is especially advantageous with respect to robotic painting.

The invention is not restricted to the above described embodiment which allows many modifications. This is especially the case for the number of different paints that may be used for a single task and which can be selected using the paint changing unit. In this respect and besides selecting paints of different colors, one also may select paints or types of paints of differing properties. It is to be understood that in lieu of paints also other liquids, in particular pigments, may be moved through the feed line 1 and that the designation "paint" in the present invention is meant to encompass all liquids suitable for coating. Moreover the various procedural steps during the cleaning stages also may be carried out in another sequence and/or in another direction and/or at different timings. Illustratively the cleaning substance may be removed in the paint's conveying direction (arrow x) following recovery of the paint column remaining in the feed line 1, for instance by mounting a second source of inert gas at the first end 1*a* of the feed line 1. Again, the source of inert gas 28 preferably shall be not a nitrogen bottle but a commercial nitrogen generator which illustratively produces atmospheric nitrogen at a pressure up to 15 bars. Also the feed line 1 may contain further appropriate components, for instance a very fine filter transmitting only particles hardly larger than the pigment size of the paint being used. Furthermore the valves 12, 14 of the color-changing unit may be combined with the outlet valve 42 into one compact block in order to further shorten the line segments 44, 45 or eliminate them entirely. It is also clear that the invention covers not only the described apparatus cleaning a paint conveying line 1, but also a full painting system including such apparatus. Lastly it is understood the various features may be combined in different ways than shown and described above.

The invention claimed is:

1. An apparatus adapted to be connected to a painting system for cleaning a paint feed line of the painting system in which the paint feed-line connects at least one paint tank to at least one paint deposition device for the purpose of moving the paint during operational stages from the tank to the deposition device, said apparatus comprising a rinsing unit to move a pressurized gas through the feed line during cleaning stages between the operational stages, wherein the rinsing unit comprises a pressurized inert-gas source; and means for filling the feed line with said inert gas at the end of a cleaning stage and for keeping the inert gas in the feed line until the next operational stage begins, thereby effectively preventing ambient air from entering the feed line in the time interval between the termination of the cleaning stage and the beginning of the next operational stage;

wherein said feed line includes first and second opposite ends connected to said tank and said deposition device, respectively;

the inert gas source is adapted to be connected to the second end of the feed line;

the means comprise a first controlled valve coupled to the inert-gas source for connecting the inert-gas source to the feed line;

the rinsing unit further comprises a cleaning-substance source connectable to the second end of the feed line, and a collection container;

said means further comprise a second controlled valve configured such that the first end of the feed line issues through the second controlled valve into the collection container;

said means further comprise a third, controlled valve;

the tank is connectable by the third, controlled valve to the feed line;

said means further comprise a fourth, controlled valve configured such that the feed line is connected at the first end by the fourth controlled valve to at least one further paint tank of the painting system;

the third valve and the fourth valve together define a paint-change unit implementing the selective feeding of paints of different properties from said tanks during the operational stages; and said means further comprise a fifth controlled valve coupled to the cleaning substance source for connecting the cleaning substance source to the second end of the feed line; and controlling means for following an operational stage, opening the first controlled valve to force the paint in the feed line, by the inert gas, back into the pertinent tank, and then, closing the third or the fourth valve and opening the second valve, and thereafter, opening the fifth controlled valve to force the cleaning substance through the feed line, and then, closing the fifth valve and allowing the cleaning substance to be removed from the feed line, and thereafter, closing the second valve after the feed line has been filled exclusively with the inert gas.

2. The apparatus as claimed in claim 1, wherein said controlling means close the first controlled valve no later than the opening of the deposition device initiating the next operational stage.

3. An apparatus adapted to be connected to a painting system, said painting system comprising a paint reservoir, a paint applicator, and a paint feed line having first and second opposite ends connected to said reservoir and said applicator, respectively, for supplying paint from the first end and said reservoir to the second end and said applicator during operational stages, said apparatus being adapted to clean said feed line during cleaning stages between the operational stages, said apparatus comprising an inert gas source connectable to the second end of said feed line for forcing the paint remaining in said feed line after one of the operational stages from the second end to the first end of said feed line;

said apparatus further comprising:

a collection container adapted to be in fluid communication with the first end of said feed line for partially collecting the remaining paint being forced out of the first end of said feed line by said inert gas;

a first controllable valve installable between said inert gas source valve and the second end of said feed line;

a control unit coupled to said first valve and configured to open said first valve to initiate a release of the inert gas from said inert gas source into said feed line at the beginning of the cleaning stage.

a second controllable valve installable between said reservoir and the first end of said feed line; and a third controllable valve installable between said collection container and the first end of said feed line;

wherein said control unit is coupled to both said second and third valves and configured to keep the second valve open and the third valve closed for a time interval after the release of the inert gas at the beginning of the cleaning stage, thereby enabling a portion of the remaining paint to return to said reservoir for a subsequent operational stage;

said control unit is further configured to close said second valve and open said third valve when a boundary between the remaining paint and the inert gas has reached a point adjacent the first end of said feed line;

said apparatus further comprises a cleaning substance source connectable to the second end of said feed line;

said control unit is coupled to said cleaning substance source and configured to release, for a predetermined period of time, the cleaning substance from said cleaning substance source into said feed line after the remaining paint has cleared the second end of said feed line under the action of the inert gas;

said apparatus further comprises a sensor for detecting the boundary between the paint and the inert gas; and said control unit is coupled to said sensor and configured to close said second valve and open said third valve upon receiving from said sensor a signal indicating a detection of the boundary between the paint and the inert gas.

4. The apparatus of claim 3, wherein said sensor is further configured to detect a boundary between the cleaning substance and the inert gas; and said control unit is configured to close the third valve after a predetermined time period has lapsed from receipt, by said control unit, of a signal from said sensor indicating a detection of the boundary between the cleaning substance and the inert gas, said predetermined time period being sufficient for the cleaning substance to completely passed the third valve.

* * * * *